US008062683B2

(12) United States Patent
Rasmussen et al.

(10) Patent No.: US 8,062,683 B2
(45) Date of Patent: Nov. 22, 2011

(54) DISPOSABLE BREWING DEVICE

(75) Inventors: Ulrik Skovgaard Rasmussen, Middelfart (DK); Werner Schulz, Horsens (DK)

(73) Assignee: Columbus E. APS (DK)

( * ) Notice: Subject to any disclaimer, the term of this patent is extended or adjusted under 35 U.S.C. 154(b) by 1188 days.

(21) Appl. No.: 11/579,241

(22) PCT Filed: May 5, 2004

(86) PCT No.: PCT/DK2004/000310

§ 371 (c)(1),
(2), (4) Date: Oct. 31, 2006

(87) PCT Pub. No.: WO2005/105604

PCT Pub. Date: Nov. 10, 2005

(65) Prior Publication Data

US 2008/0003337 A1 Jan. 3, 2008

(51) Int. Cl.
*A23F 5/00* (2006.01)

(52) U.S. Cl. ..... 426/433; 426/431

(58) Field of Classification Search ..... 426/433, 426/431

See application file for complete search history.

(56) References Cited

U.S. PATENT DOCUMENTS

| | | | | |
|---|---|---|---|---|
| 3,199,437 | A | 8/1965 | Nelsen | |
| 3,337,117 | A * | 8/1967 | Lehmacher et al. | 383/37 |
| 3,352,226 | A | 11/1967 | Nelsen | |
| 3,372,634 | A | 3/1968 | Brinkman et al. | |
| 3,800,690 | A * | 4/1974 | Molenaar et al. | 99/295 |
| 3,935,318 | A * | 1/1976 | Mihailide | 426/80 |
| 3,985,069 | A * | 10/1976 | Cavalluzzi | 99/295 |
| 4,061,793 | A * | 12/1977 | Daswick | 426/433 |
| 4,069,751 | A * | 1/1978 | Gronwick et al. | 99/306 |
| 4,220,541 | A * | 9/1980 | Chang | 210/474 |
| 4,619,830 | A * | 10/1986 | Napier | 426/82 |
| 4,627,334 | A * | 12/1986 | Shanklin | 99/306 |
| 4,685,583 | A * | 8/1987 | Noon | 220/710.5 |
| 4,867,993 | A * | 9/1989 | Nordskog | 426/77 |
| 4,875,408 | A * | 10/1989 | McGee | 99/283 |
| 4,886,674 | A | 12/1989 | Seward et al. | |
| 4,983,410 | A * | 1/1991 | Dinos | 426/77 |
| 5,064,980 | A * | 11/1991 | Grossman et al. | 219/689 |
| 5,243,164 | A * | 9/1993 | Erickson et al. | 219/689 |
| 5,277,103 | A * | 1/1994 | Cox | 99/323 |
| 5,390,587 | A | 2/1995 | Wu | |
| 5,424,083 | A * | 6/1995 | Lozito | 426/82 |
| 5,582,731 | A * | 12/1996 | Gianfranco | 210/477 |

(Continued)

FOREIGN PATENT DOCUMENTS

DE 609 794 2/1935

(Continued)

OTHER PUBLICATIONS

International Search Report; PCT/DK2004/000310; Jan. 20, 2005.

*Primary Examiner* — Anthony Weier
(74) *Attorney, Agent, or Firm* — Cantor Colburn LLP

(57) ABSTRACT

The invention relates to a disposable brewing device including at least one inner compartment formed by a liquid-permeable material and containing aroma material, at least one outer compartment forming a brewing container where the brewing container is formed by a liquid-impermeable material, the at least one liquid-permeable inner compartment being integrated within the brewing container.

51 Claims, 7 Drawing Sheets

U.S. PATENT DOCUMENTS

| | | | | |
|---|---|---|---|---|
| 5,605,710 | A * | 2/1997 | Pridonoff et al. | 426/86 |
| 5,633,026 | A * | 5/1997 | Gruenbacher | 426/77 |
| 5,775,205 | A * | 7/1998 | Melton | 99/322 |
| 5,842,408 | A | 12/1998 | Hatta | |
| 6,079,318 | A * | 6/2000 | Davis | 99/323 |
| 6,138,551 | A * | 10/2000 | Bauer et al. | 99/323 |
| 6,189,438 | B1 * | 2/2001 | Bielfeldt et al. | 99/321 |
| 6,277,547 | B1 | 8/2001 | Bourdelais et al. | |
| D448,602 | S | 10/2001 | Bodum | |
| 6,431,056 | B1 * | 8/2002 | Fritschi | 99/320 |
| 6,622,615 | B2 | 9/2003 | Heczko | |
| 6,715,616 | B2 * | 4/2004 | Kataoka | 210/474 |
| 7,032,507 | B2 * | 4/2006 | Cai | 99/323 |
| 7,235,272 | B2 * | 6/2007 | Saitoh et al. | 426/82 |
| 7,258,884 | B2 * | 8/2007 | Albrecht | 426/433 |
| 2004/0118295 | A1 * | 6/2004 | Angeles | 99/279 |
| 2005/0056153 | A1 * | 3/2005 | Nottingham et al. | 99/279 |
| 2005/0109213 | A1 * | 5/2005 | Terada | 99/279 |
| 2006/0272510 | A1 * | 12/2006 | Tsay | 99/279 |
| 2008/0153962 | A1 * | 6/2008 | Xia et al. | 524/413 |

FOREIGN PATENT DOCUMENTS

| | | |
|---|---|---|
| JP | 62-10828 | 1/1987 |
| JP | 4210010 A | 7/1992 |
| JP | 7-24225 | 5/1995 |

* cited by examiner

DISPOSABLE BREWING DEVICE

TECHNICAL FIELD OF THE INVENTION

The present invention relates to a disposable package for brewing of e.g. coffee or tea according to claim 1.

BRIEF DESCRIPTION OF RELATED ART

A coffee maker such as described in USD448602S constitutes both a coffee maker and a coffee pot in one device. However this kind of coffee maker requires cleaning after use and is not well-suited for one-time-use. The equipment is too expensive and is per se not suitable for disposal.

An example of a device for one-time-use related to the making of coffee is U.S. Pat. No. 4,886,674 disclosing a beverage making cartridge made of an air- and water-impermeable material and containing a product, which provides a beverage such as soup, chocolate and coffee when mixed in aqueous medium. A web material is located in the sachet below the product. When using the sachet, pressurized liquid is introduced from the top of the sachet, into the sachet and through the sachet and the web material, whereby the bottom of the sachet is opened. The sachet may eventually be provided with a nozzle in the top of the sachet. A drawback of this invention is that pressurized liquid is required in order to utilize the device and dedicated equipment is needed for using it. Thus, a handheld-based brewing of coffee is not applicable.

One problem is to be able to make coffee of good and uniform quality without a machine or a coffee pot or a conventional coffee filter and funnel. This problem has at least partly been dealt with in U.S. Pat. No. 5,842,408, which describes a solution in which a package contains a filter and a foldable funnel suited for arbitrary drinking cups. The illustrated solution suffers from the drawback that it is expensive to manufacture as the foldable funnel frame forms a body separate from the outer bag, thereby complicating the manufacturing process.

One of several problems addressed by the invention is a reduction in manufacturing costs, both with respect to the manufacturing process and with respect to consumption of materials needed for the device.

Another problem addressed by the invention is to avoid necessity of specialized brewing equipment.

SUMMARY OF THE INVENTION

The invention relates to a disposable brewing device 1 comprising at least one inner compartment 2 said inner compartment being formed by a liquid-permeable material 4 and containing aroma material 5, at least one outer compartment forming a brewing container 3 said brewing container being formed by a liquid-impermeable material 6, said at least one liquid-permeable inner compartment 2 being integrated within said brewing container 3.

The inner compartment integrated within the brewing container is preferably located inside the brewing container and fastened hereto. This among other things contributes to the important advantage of the present invention that the brewing device is ready for use and no equipment is needed to support it during use. Preferably, the disposable brewing device is intended to use with liquid such as water or e.g. alcohol or milk. In the present invention a disposable device is defined as a device intended for one or a few times of use.

The liquid-permeable material needs no support as it is fastened to the brewing container.

In an embodiment of the invention, said outer compartment 3 is formed by film material.

A film material according to the invention may comprise both a single and/or a multi-layer structure. The layers may be laminated, mutually welded, or generally gathered. Preferably, the inner layer of a multi-layer film may comprise a so-called sealant facilitating the desired brewing device defining gatherings.

In an embodiment of the invention said brewing device comprises a substantially air, aroma-, and liquid-impermeable outer sealing.

The outer sealing forms a barrier between the outer environment and the environment inside the sealing. Hereby the aroma material contained is protected and its shelf life prolonged.

In an embodiment of the invention said brewing container is forming the outer sealing of the brewing device.

In a preferred embodiment no separate outer sealing 41 is needed, as the liquid-impermeable material of the brewing compartment 3 itself forms a sealed barrier for air comprising gasses such as oxygen, aroma and liquid such as water or moisture. When the brewing container itself forms the outer sealing both material- and production-expenses in supplying an extra wrapping are saved.

In an embodiment of the invention, the inner compartment material, the brewing container material and the outer sealing are formed as bags or pouches.

It is an advantage of the present invention that the bag-like characteristic implies that the whole brewing device before use appears as a flat package, whereby it takes up only a small amount of space.

In an embodiment of the invention the brewing container 3 and the inner compartment 2 and the outer sealing are formed from sheets, webs, rolls or lengths of structural material.

Generally forming all parts of the brewing device out of e.g. webs of structural material contributes to a simple and cost saving manufacturing process.

In an embodiment of the invention the brewing container and/or the inner compartment may each be formed out of one single sheet of structural material. In a further embodiment two, three or more sheets of material are assembled to form the brewing container and/or the inner compartment.

In an embodiment of the invention said bags or pouches forming the brewing container 3, the inner compartment 2 and the outer sealing are assembled by weldings at the edges.

In an embodiment of the invention the heat resistance of the structural material of the brewing container 3 and inner compartment material 4 is up to at least 100° C.

The inner compartment material and the outer compartment material are advantageously resistant to the temperature of boiling water.

In an embodiment of the invention atmospheric pressure is sufficient for using the brewing device 1.

In relation to coffee brewing it is an important feature of the brewing device according to the invention that it enables the user to brew coffee in the traditional way. The traditional brewing implies that no pressure above the atmospheric pressure is needed in order to make the water pass through the liquid-permeable material. Furthermore the brewing device according to the invention advantageously needs no extra or special equipment to function.

In an embodiment of the invention said liquid-impermeable material comprises walls and bottom of said brewing container.

In an embodiment of the invention said liquid-impermeable bottom material is more flexible than said wall material.

The bottom material and wall material may preferably be adjusted according to each other in order to provide a brewing container, which may expand easily.

In an embodiment of the invention said liquid-impermeable material of the brewing container comprises at least one film or foil selected from the group of metal foils, polymer films, metallized or coated films, polymer sealants, polyesters, polyamides and polyolefines comprising polyethylenes and polypropylenes or any combination thereof.

In an embodiment of the invention the liquid-impermeable material of the brewing container 3 has a rigidity, which is large enough to allow the brewing container to be self-standing.

Materials having a high rigidity are preferred in order for the container to be able to stand by itself. The side wall material of the outer sealing has a rigidity and heat stability to secure stability during manufacture and handling of the brewing device.

In an embodiment of the invention the liquid-impermeable material of the brewing container 3 has a thickness in the range of 10 μm to 2 mm, preferably 40 μm to 500 μm, more preferably 60 μm to 200 μm and most preferably 80 μm to 150 μm.

In dependence of the material chosen the thickness is preferably adjusted in order to obtain a rigidity, which allows the brewing container to be self-standing.

In an embodiment of the invention the liquid-impermeable material comprises a multi layer structure.

In an embodiment of the invention a preferred combination of materials for a multi layer structure for sidewall material and bottom material of the brewing container may comprise an outside polymer film, an intermediate barrier layer and an inside layer of polymer sealant (e.g. HDPE).

In an embodiment of the invention said brewing container comprises a translucent or at least semi-translucent liquid-impermeable material.

The coating of an at least partly translucent brewing container may comprise ceramic materials such as aluminium oxides, zirconium oxides, glasses based on silicium oxide or other coating materials such as ethylene vinyl alcohol (EvOH) and combinations thereof. A translucent brewing container may be of convenience in use as it is possible to observe the brewing process. The storage capabilities i.e. shelf life of the brewing container before use may be reduced, as a translucent material is obviously not light tight, but a sealing wrapped around the brewing container may solve this problem.

In an embodiment of the invention said translucent or at least semi-translucent liquid-impermeable material comprises an UV-filter.

In an embodiment of the invention said bottom of the brewing container comprises a shape sealed fold The bottom fold enables the container to be self-standing and hence no equipment is needed to support the brewing device, as the container stands by itself. The shape of the weld of the bottom fold significantly affects the shape of the brewing container when filled with liquid, which means that the brewing container during use may attain e.g. a circular-, oval-, or rectangular-like bottom form.

In an embodiment of the invention the brewing container may comprise alternative bottom constructions also allowing the brewing container to attain standing abilities. The bottom construction may e.g. be non-folded.

In an embodiment of the invention said brewing container 3 forms at least a part of the fixation and support for the inner compartment 2.

In a preferred embodiment of the invention, the outer brewing compartment, i.e. the brewing container forms substantially all of the fixation and support for at least one of the at least one inner compartments both before and during brewing.

In an embodiment of the invention said brewing container is formed as a stand-up pouch.

In an embodiment of the invention the brewing container comprises a discharging arrangement.

The discharging arrangement may comprise a pour spout or another kind of small opening to secure that the beverage may be poured from the brewing container in a controlled manner with regard to amount and flow of the brewed beverage.

In an embodiment of the invention the brewing container is closed in the top by a peelable sealing.

The peel-able sealing may e.g. comprise polyethylene, a peelable coating or a peelable film formed by different techniques. The peelable sealing has the advantage of forming a barrier for gasses, aroma, moisture, etc. until it is broken.

In an embodiment of the invention the peelable sealing comprises a filmstrip or a peelable strip of a hot melt type.

The hot melt type peelable strip may be applied to at least one of the mutually facing surfaces, which are joined to a peelable sealing in the top of the brewing compartment or somewhere in a separate outer sealing. Likewise the peelable strip may be arranged either in the top or at another suitable location for a peelable sealing, which is to be broken by the user of the disposable brewing device of the present invention.

In an embodiment of the invention the brewing container is equipped with at least one handle.

The handle, which may attain different shapes and be mounted to the brewing container in different ways, may allow the user to lift, move and tilt the brewing container safely. Still with the objective of making the brewing container easy and safe to handle it may be preferred to equip the brewing container with two or several handles.

In an embodiment of the invention said brewing container comprises a top closing arrangement.

The closing arrangement may facilitate re-closing of the brewing container after liquid has been added. This closing may contribute to the isolation effect of the brewing container. The brewing container may form a kind of thermos package keeping the brewed beverage either warm or cold for a considerable time period. The closing arrangement may further have the effect of preventing loss of beverage, for example if the brewing container accidentally falls. Moreover the closing arrangement may contribute to protecting the user of the brewing container from getting into unwanted contact with the beverage being e.g. hot, sticky, colored etc.

In an embodiment of the invention the closing arrangement comprises a flap, a slide fastener, an adhesive material or combinations thereof.

The closing arrangement may for example be a flap-solution comprising adhesive material or non-flap-solution comprising a slide fastener.

In an embodiment of the invention said liquid-permeable inner compartment material 4 comprises punctured etched, melted, stamped or cut plast, polyolefines such as polyethylene or polypropylene, polyesters, polyamides and other polymers, woven or non-woven expanded plastic, cloth, screen, wire-mesh, metal or injection molded plastic.

In an embodiment of the invention said liquid-permeable inner compartment material 4 comprises a film material.

In an embodiment of the invention the liquid-permeable material 4 of the inner compartment 2 is provided with holes 7, which have been created by stamping, cutting, etching or melting.

The liquid-permeability of the inner compartment material may for example be obtained by a perforation of small holes 7. The liquid-permeable material, which is provided with holes, may be described as punctured with a certain density of holes per $cm^2$.

In an embodiment of the invention the liquid-permeable material 4 is provided with a density of holes in the range of 1-30 holes per $cm^2$, preferably 2-20 holes per $cm^2$ and most preferably 4-12 holes per $cm^2$.

In an embodiment of the invention the holes 7 have dimensions in the range of 0.01 mm·0.01 mm to 2.00 mm·2.00 mm, preferably 0.1 mm·0.1 mm to 1.0 mm·1.0 mm, more preferably 0.1 mm·0.1 mm to 0.6 mm·0.6 mm The preferred size of the hole is an elongated hole of the size 0.2 mm·0.4 mm. The shape of the hole may vary from application to application.

In an embodiment of the invention the dimension of the holes 7 is adapted to provide a brewing time of approximately 3-6 minutes under atmospheric pressure.

In an embodiment of the invention the inner compartment 2 is made of a material selected from the group of polypropylene, polyethylene, polyesters, polyamides, polyolefines or other polymers.

Preferably the structural material of the inner compartment is welding compatible with the sealant of the brewing container.

In an embodiment of the invention said brewing device 1 is formed by mutually welded film materials.

Preferably, the inside of the outer sealing is weldable to the inner compartment material.

In an embodiment of the invention the inner compartment comprises a pouch.

In an embodiment of the invention the inner compartment is sealed.

It may be preferred to seal the inner compartment, which contains aroma material to ensure that the aroma material is staying in the inner compartment during transport and storage. Thereby transfer of aroma material to the outer brewing compartment i.e. the brewing container is prevented. The sealing may be broken before use, if it is preferred to add liquid into the inner compartment, e.g. through an opening at the top.

In a preferred embodiment a specific sealing of the inner compartment is not required, as the inner compartment may be situated in close vicinity to a sealing in the top of the outer brewing compartment, and consequently transfer of aroma material may be prevented by design.

In an embodiment of the invention the inner compartment is open.

It may be an advantage for the user of the brewing device to provide the aroma material at the time of use. In such case for example there is no need for a sealing of the inner compartment, as the inner compartment does not contain aroma material during transport and storage.

In an embodiment of the invention said inner compartment has a volume size in the range of 10 to 95% of the brewing container volume, preferably 50% to 90% of the brewing container volume.

The volume size of the inner compartment may be established by different means such as the size of the inner compartment material sheets, and in a preferred embodiment of the invention by the position of specific weldings in the inner compartment material. An example of such welding positions is illustrated in FIG. 17.

The volumes of the inner and outer compartment may be adjusted with respect to each other in order to create a space for interaction between liquid and aroma material. E.g. in coffee brewing an infusion process may hereby be facilitated.

Generally different shapes and localizations of the inner compartment may be provided in order to adjust the flavor concentration and strength of the beverage. Thereby the design of the brewing device comprising inner and outer compartments may inherently contribute to the adjustment of a beverage. If the beverage for example is coffee the design may influence the coffee to be mild, strong etc.

In an embodiment of the invention the inner and outer compartments are designed so that a large percent of the inner compartment material does not touch the sidewalls or bottom of the outer compartment.

In an embodiment of the invention said volume size is regulated by the position of a welding seam in the inner compartment material.

In an embodiment of the invention the brewing device comprises at least two separate inner compartments arranged inside or alongside each other.

In an embodiment of the invention it may be preferred to equip the brewing device with more than one inner compartment. The different compartments may be used for different aroma materials, which are to be mixed during brewing. Their separation in different compartments secures that they are not mixed before use.

In an embodiment of the invention the brewing container 3 and the inner compartment 2 are mutually fastened by welding.

In an embodiment of the invention the inner compartment comprises a bottom fold.

In an embodiment of the invention alternative bottom constructions of the inner compartment, e.g. a non-folded construction may be preferred. According to the invention the design of the folded or non-folded bottom of the inner compartment may affect the quality of the brewed beverage, for example by affecting the surface area of inner compartment material.

In an embodiment of the invention the outer sealing is made of a material selected from the group of metal foils, polymer films, metallized or coated films, polymer sealants, polyesters, polyamides and polyolefines comprising polyethylenes and polypropylenes or any combination thereof.

In an embodiment of the invention said outer sealing comprises a multi layer structure.

In an embodiment of the invention said outer sealing comprises a laminate.

A laminate composition of the structural material may facilitate a material, which is light, tight and stabile during manufacturing, storage and handling of the brewing device.

In an embodiment of the invention the structural material of the brewing container 3 is coated with a protective film and/or a barrier layer.

In case the container material itself is not light-tight it is preferred to coat it in order to protect the aroma material contained.

When the brewing device is packed with aroma material such as ground coffee beans having a tendency to loose aroma when exposed to the surroundings, it is of crucial importance that the barrier layer is tight, especially when the amount of aroma material is relatively small compared to larger coffee packages.

In an embodiment of the invention said outer sealing comprises at least one polymer film, metallized or coated film, EvOH-coating, metal foil, sealant, or combinations thereof.

In an embodiment of the invention the multi layer structure of the brewing container material comprises an outside polymer film, an intermediate barrier layer and an inside layer of polymer sealant.

In an embodiment of the invention a preferred combination of materials for a multi layer structure of the sidewalls of the brewing container or of a separate outer sealing may comprise an outside polymer film, an intermediate barrier layer comprising a metal foil and an inside layer of polymer sealant (e.g. HDPE).

Likewise in an embodiment of the invention a preferred combination of materials for a multi layer structure, which forms the bottom material of the brewing container or of a separate outer sealing may comprise a similar multi layer structure, wherein the intermediate metal foil barrier layer is substituted for a barrier layer comprising a polymer film being metallized and coated with e.g. EvOH (ethylene vinyl alcohol).

In an embodiment of the invention differences in flexibility of the sidewall material and bottom material of the brewing container are manipulated by substitutions, e.g. as described above, where the substitution of metal foil with a metallized film coated with EvOH may facilitate a more flexible multi layer material.

In an embodiment of the invention said aroma material comprises roast and/or ground coffee, instant coffee, tea, milk powder, herb, fruit, meat, chocolate powder, vegetables, grains or any combination thereof or any other materials which comprises or provides flavor or aroma or other functionalities.

Other functionalities than flavor or aroma may for example be color, consistency, energy etc.

The beverages made by the brewing device may for example be coffee, espresso, latte, mocha, tea, iced drinks, hot chocolate, blended drinks, fruit juices or any other edible or drinkable fluids.

In an embodiment of the invention a disposable brewing device is used for brewing of a beverage.

In an embodiment of the invention the method of brewing a beverage in a disposable brewing device comprises that the beverage is obtained by adding liquid into said brewing container under substantially atmospheric pressure.

In an embodiment of the invention the method of brewing coffee in a disposable brewing device comprises that the coffee is obtained by adding hot water into said brewing container under substantially atmospheric pressure.

When the brewing device is used for making coffee the brewing process may involve that coffee grounds are mixed with water, causing an infusion process during which the coffee grounds and water may interact, which may include that the coffee grounds absorb water and thereafter fall down while giving off aroma to the water and thereby bringing about a coffee beverage.

THE FIGURES

The invention will be described with reference to the drawing where

FIGS. 1A and 1B illustrate a disposable brewing device according to an embodiment of the invention, FIG. 2 illustrates a cross-section of the brewing device 1 of FIG. 1A at the line II-II, FIG. 3 illustrates a cross-section of the brewing device 1 of FIG. 1A at the line III-III, FIG. 4 illustrates a cross-section of the brewing device 1 of FIG. 1A at the line IV-IV, FIG. 5-10 illustrate a brewing process when applying the brewing device of FIG. 1A, FIG. 11 illustrates a further embodiment of the invention, FIGS. 12 and 13 illustrate a brewing process when applying the brewing device of FIG. 11, FIG. 14-16 illustrate an alternative brewing process when applying the brewing device of FIG. 11, FIG. 17 illustrates the brewing device of FIG. 1A further comprising an adjustment of the inner compartment volume, and FIG. 18 illustrates the brewing device of FIG. 1A further comprising a separate outer sealing.

DETAILED DESCRIPTION

For reasons of explanation, parts of the brewing device of FIG. 1A and FIG. 5 to 18 are shown as partly transparent.

FIGS. 1A and 1B illustrate a front view and a side view, respectively, of a brewing device 1 in an embodiment of the invention.

The brewing device 1 comprises an outer brewing compartment 3 also referred to as a brewing container and as an outer bag. Sheet materials 6, a bottom welding 9, two side weldings also referred to as fusion seals 8 and an upper breakable sealing 18 collectively define the outer brewing compartment. The sheet material 6 furthermore forms a handle 12 reinforced by a continuous lamination over the complete area of the handle 12 defining areas. The upper part of the outer bag comprises a top sealing or closing, e.g. a flap 11 formed by a sheet portion. The top closing 11 is preferably formed with an adhesive for the purpose of closing the bag when liquid has been poured or injected into the device 1. Further explanation of the functionality of the device 1 during use in this respect will be given below. At the top of the brewing compartment 3 the sheet materials 6 are joined in a peelable sealing 18, and above the sealing 18 a part of the sheet material 6 forms a clutch-flap 19. A sheet material 10, see also the FIG. 2-4, forms a lower part of the outer brewing compartment 3 and the sheet material 10 is laminated to the side welding 8 and is formed by the continuous lamination 9. The lower arrangement provides a reinforced self-standing arrangement when the outer compartment 3 has been filled with liquid. The basic principle of the lower arrangement is well-known within the art.

Furthermore the brewing device comprises an inner compartment 2 defined by a filter material 4 and welded to the outer compartment 3 defining sheets 6. The inner compartment comprises an aroma material 5, illustrated in FIG. 2-4.

Evidently, the fastening of the inner compartment 2 to the outer compartment 3 may be performed in several different ways, e.g. by welding, heat lamination, gluing, etc. and the fastening points may be discrete or continuous, e.g. one or both of the weldings 8. It should in this context be noted that an inner compartment in principle may be freely "floating" within the outer compartment although a kind of suspension or fixation of the inner compartment with respect to the outer compartment is preferred.

The illustrated filter material 4 comprises a polymer film comprising a number of discrete holes 7 of an appropriate size obtained e.g. by stamping. The sizes of the holes may be adjusted to the desired filter function with respect to the applied aroma material 5.

In FIG. 2-4, three different cross-sections of the expanded disposable brewing device of FIG. 1A are showed at the lines II-II, III-III and IV-IV of FIG. 1A respectively.

FIG. 2 illustrates a cross-section at the line II-II of the brewing device 1. The illustrated brewing device basically comprises two compartments as described above, namely an inner compartment 2 formed by a filter material 4 located within an outer compartment 3 basically formed by the sheets 6 and 10 by the above described gathering, e.g. welding. The inner compartment 2 comprises an aroma material 5. The above-described continuous lamination 9 of the sheet material 10 to the sheets 6 forms a part of a bottom support structure, which may ensure that the brewing device is self-standing when the outer and inner compartments are filled with liquid.

Figure 1A:
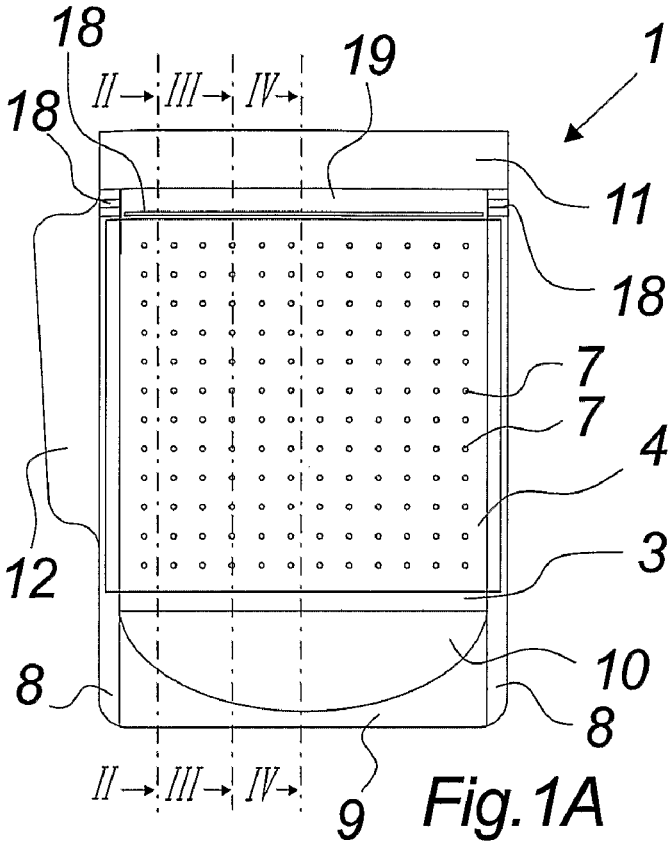
Figure 1B:
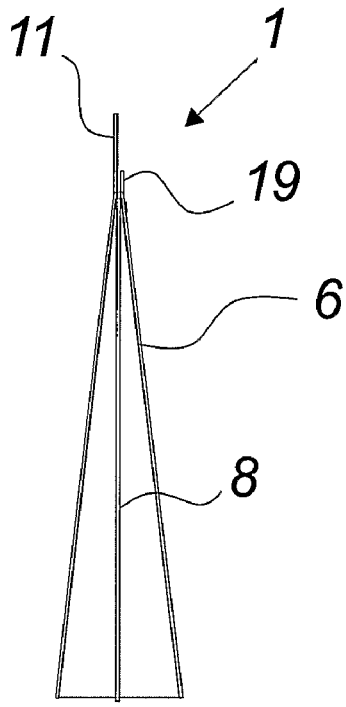
Figure 2:
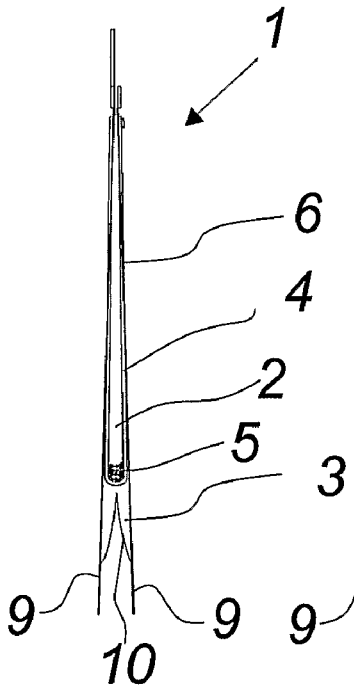
Figure 3:
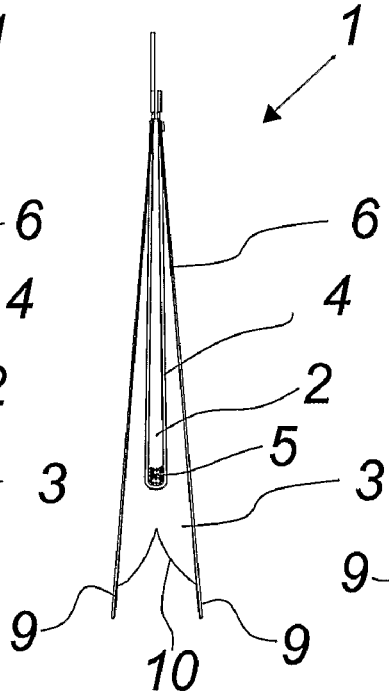
FIG. 3 illustrates a cross-section at the line III-III of the unfolded brewing device 1 of FIG. 1B and FIG. 2 at a cross-section a little closer to the line IV-IV of FIG. 1A. It is noted that the distance between the inside walls at the bottom of the outer compartment 3 is increased when compared to the cross-section of FIG. 2.
Figure 4:
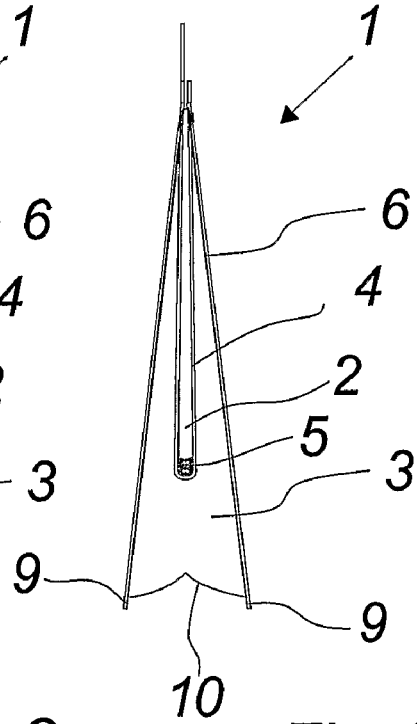
FIG. 4 illustrates a cross-section of the line IV-IV of the unfolded brewing device 1 of FIG. 1B, FIG. 2 and FIG. 3 in the midst of a the brewing device at line IV-IV. It is noted that the distance between the inside walls at the bottom of the outer compartment 3 is increased when compared to the cross-section of FIG. 3.

It is noted that according to an alternative and preferred embodiment of the invention, the sheets 6 and sheet material 10 may be formed by one single folded sheet. This sheet may comprise a lower arrangement defining welding corresponding to the above described sheet 6 and 10 gathering welding 9 and of course the already described side defining weldings 8.

It is furthermore noted that according to a preferred embodiment of the invention the brewing container materials comprising sheet materials 6 and 10 combined with weldings 8 and 9 and a peelable sealing 18 in the top collectively form an outer sealing of the brewing device. This outer sealing may effectively form a barrier for gasses, moisture, aroma and other matters so that diffusion in and out of the brewing container is prevented. Thus the aroma material 5 contained in the brewing container is hereby protected until the top peelable sealing 18 is broken.

FIG. 5-10 illustrates the process of using an aroma material 5 containing brewing device as described in FIGS. 1A, 1B and 2-4. According to the illustrated embodiment the aroma material comprises coffee grounds.

Figure 5:
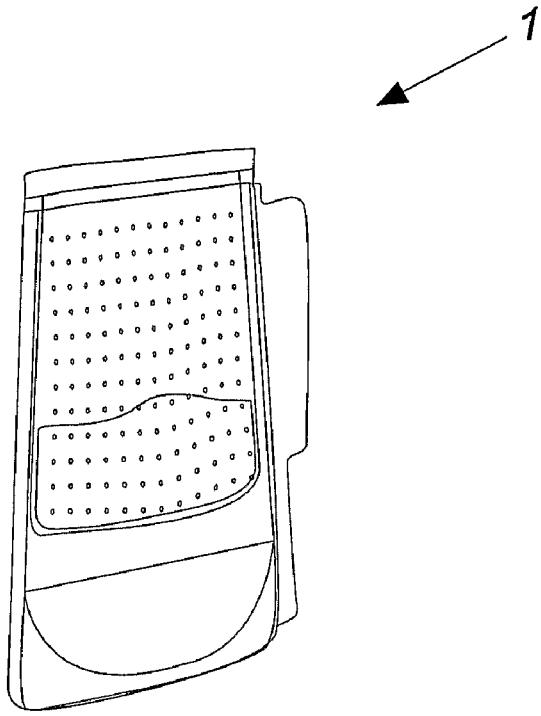

In FIG. 5 a brewing device 1 according to FIG. 1A is provided.

Figure 6:
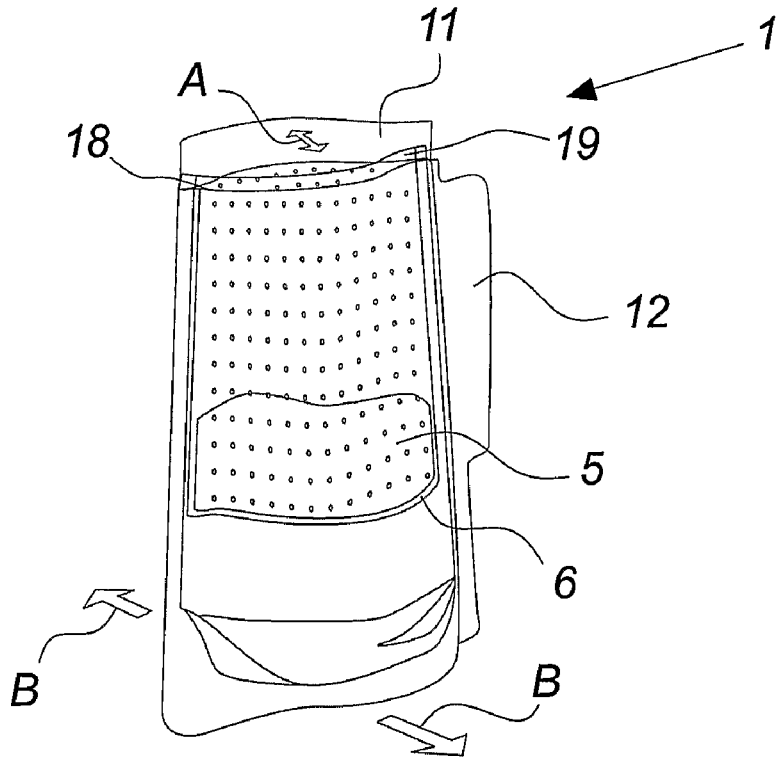

In FIG. 6 the brewing device is initially opened by mechanically stretching to the sides of the arrows A and B. Hereby the peelable sealing 18 is broken. Clutching and pulling in the flaps 11 and 19 may perform the stretching to the sides of arrow A.

Evidently, according to a further embodiment of the invention, the initial step of mechanically stretching to the sides of the arrows B may be omitted as the liquid may perform the task during filling.

Figure 7:
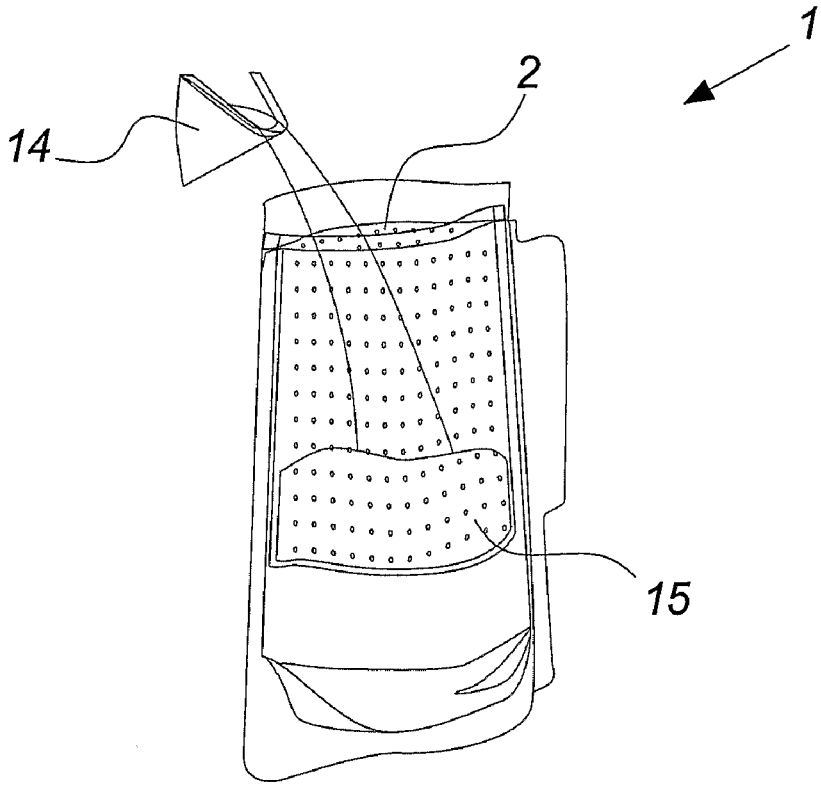

In FIG. 7 a liquid dispenser 14 such as a kettle pours liquid into the brewing device 1. The liquid, preferably hot, mixes with the coffee grounds and forms a liquid coffee suspension 15 within the inner filter compartment 2.

Figure 8:
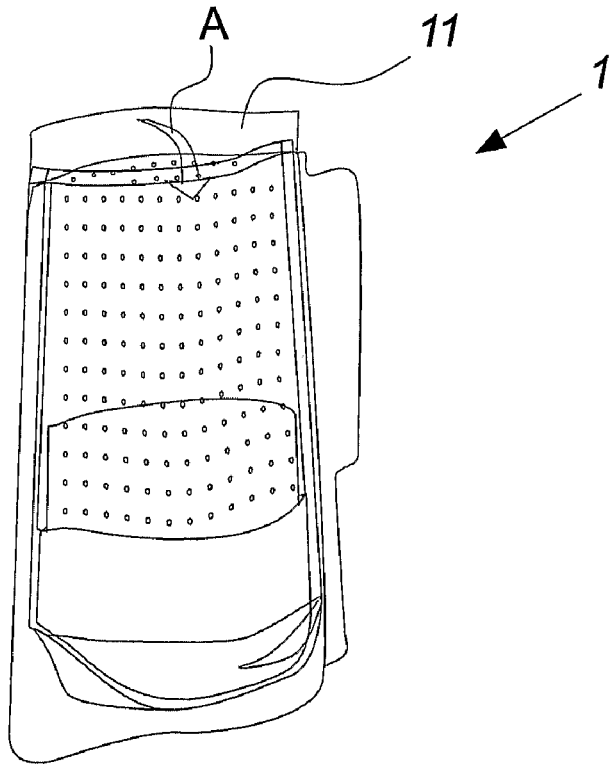

In FIG. 8 the top flap 11 is folded in the direction of the arrow A.

Figure 9:
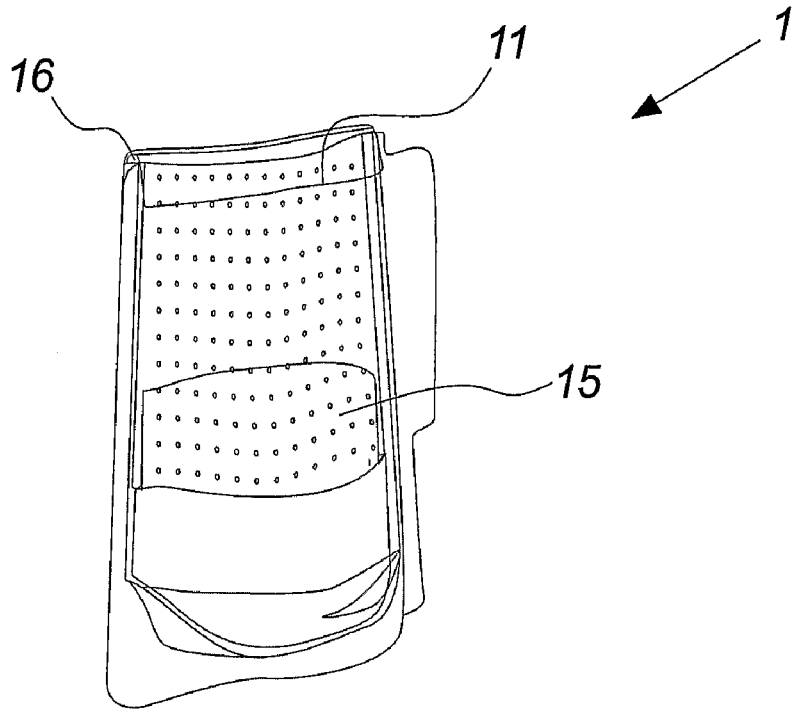

In FIG. 9 the closing of the top flap 11 has been completed and the suspension 15 is now contained within the outer compartment of the brewing device and maybe partly within the inner compartment. The closing of the top flap 11 establishes a closed container having an opening 16, which forms a kind of discharging arrangement or pour spout. Typically, the brewing device should now rest for e.g. 1-20 minutes and when brewing e.g. coffee, preferably 2-7 minutes before the brewing is completed.

Figure 10:
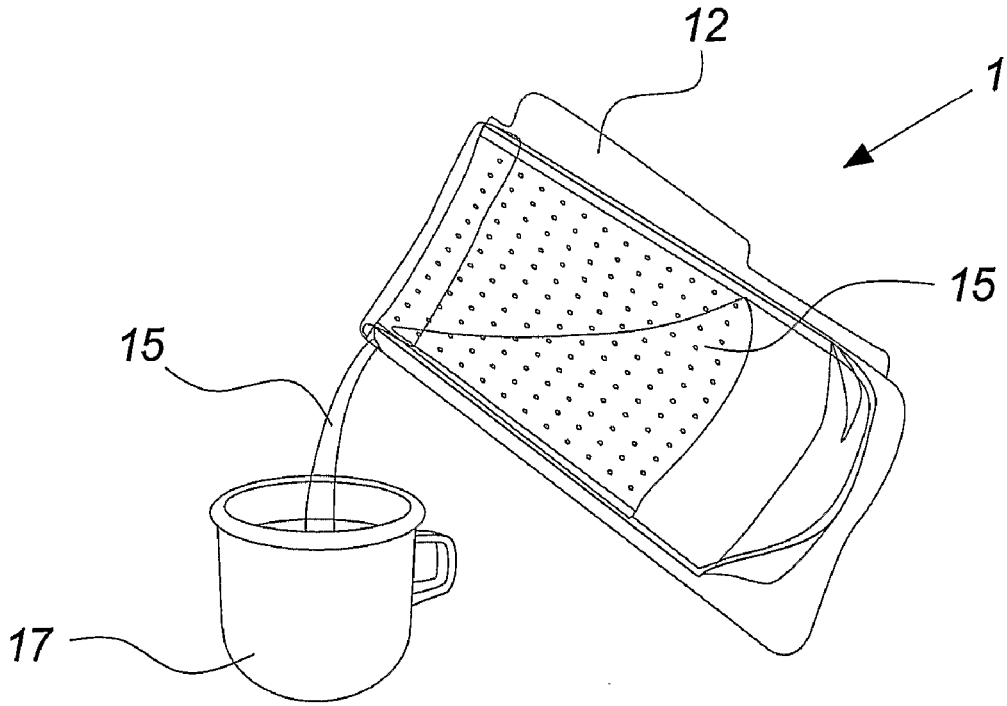

In FIG. 10 the brewing has been completed and a user may now, e.g. by means of the handle 12 lift the brewing device 1 and pour the brewed liquid 15, here coffee, into a cup 17 and the drink is ready for intake. Note that the granules of the suspension 15 remains completely or at least substantially in the inner compartment of the brewing device 1, thereby ensuring that the obtained coffee is free of annoying substances.

Figure 11:
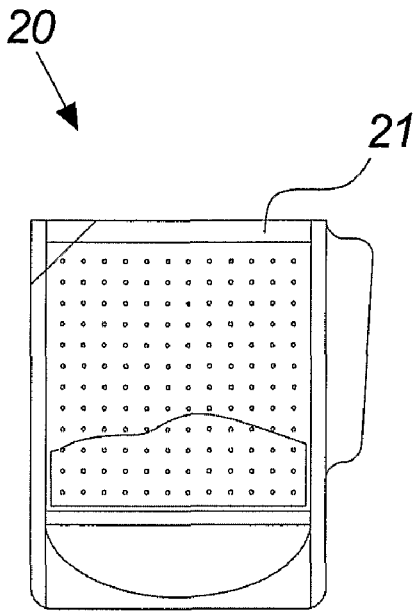

FIG. 11 illustrates an alternative embodiment 20 of the invention substantially corresponding to the illustrated embodiment of FIG. 1A, but now with a permanent upper sealing 21.

Figure 12:
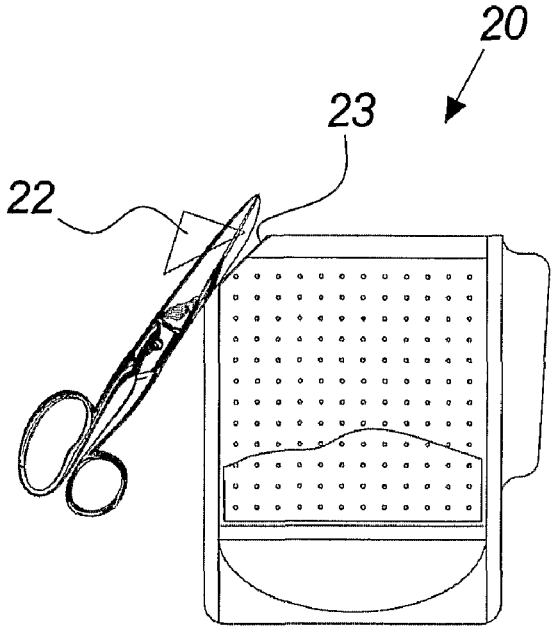

In FIG. 12, a user simply obtains access to the brewing device by cutting a slip 22 of the sealed brewing device 1 thereby forming an opening 23.

Figure 13:
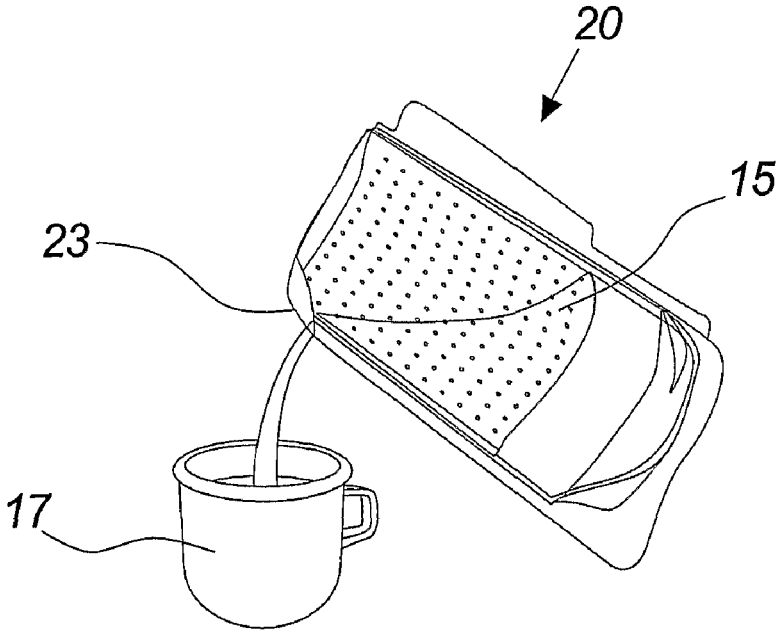

In FIG. 13 liquid, preferably water, has been injected or poured into the brewing device and the brewed liquid 15 may now be poured into e.g. a cup 17 by means of the opening 23.

Figure 14:
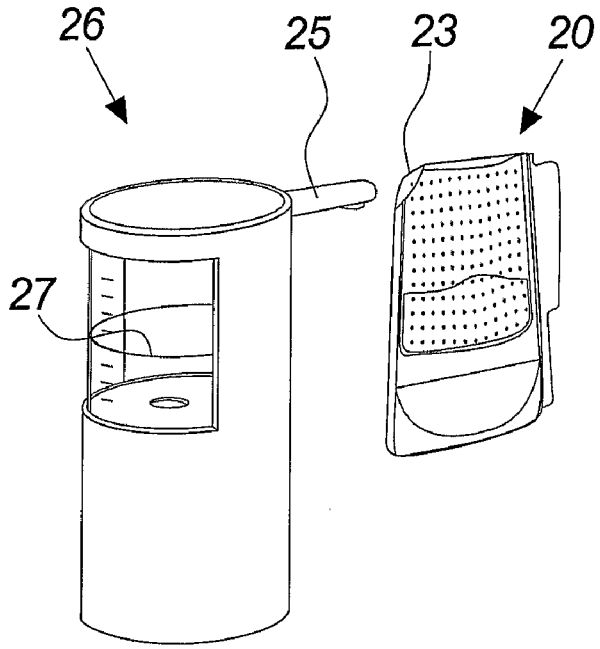
Figure 15:
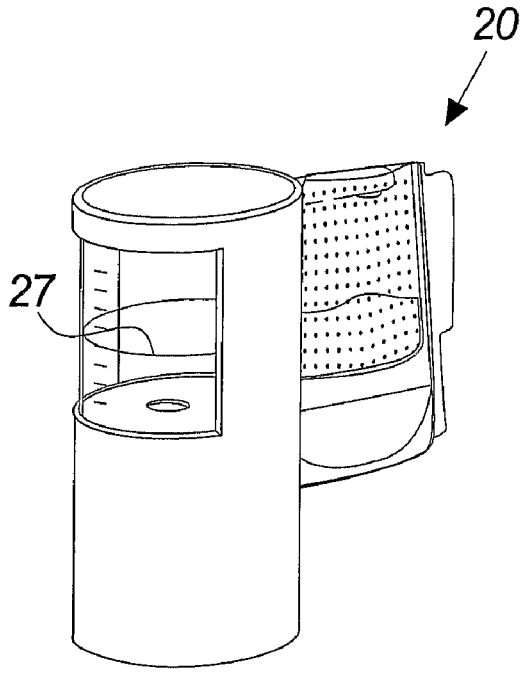
Figure 16:
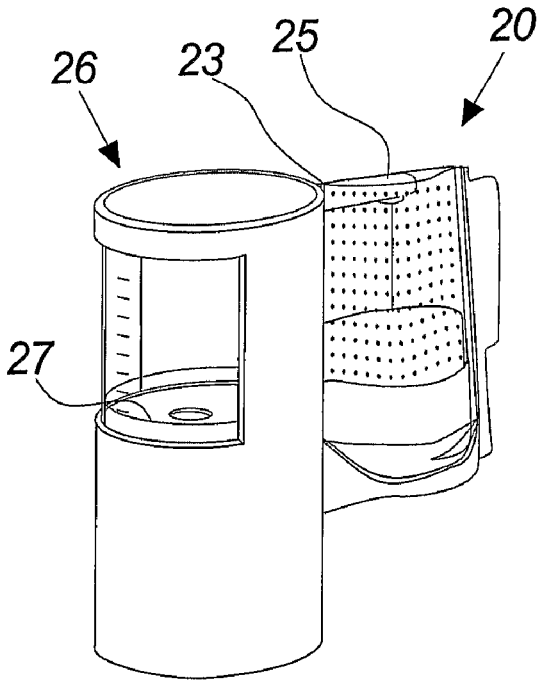

FIG. 14-16 illustrate one of several different ways of injecting liquid into the brewing device of FIG. 12. According to this embodiment an accessory device 26 is applied for the purpose. The accessory liquid containing device 26 comprises a pipe stub 25 adapted for insertion into the opening 23 of the brewing device 20.

In FIG. 15 the brewing device 20 is suspended in the pipe stub 25 and in FIG. 16 liquid 27 is injected into the brewing device and the brewed liquid may subsequently be dispensed via the opening 23.

Figure 17:
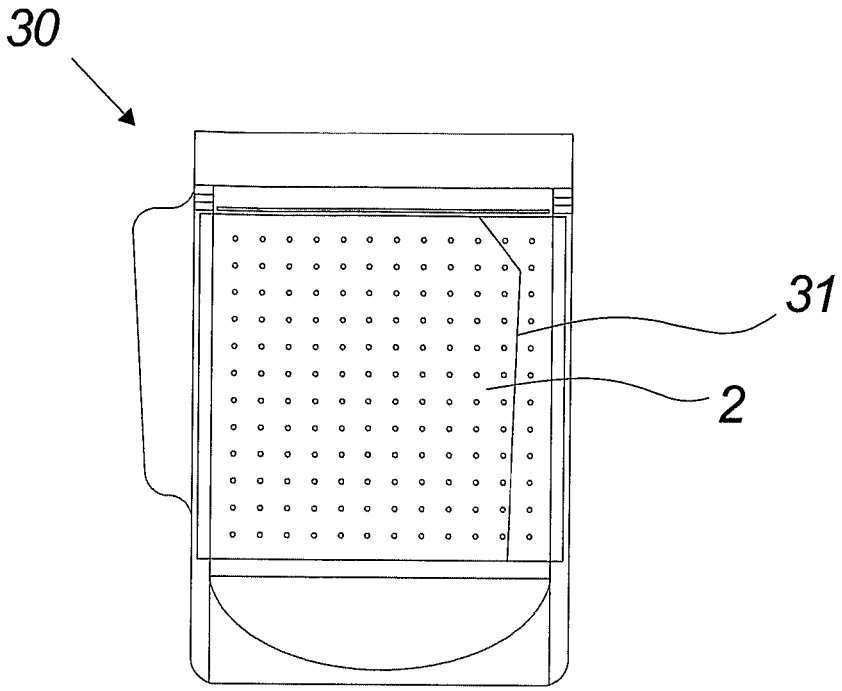

FIG. 17 illustrates an alternative embodiment 30 and one of several different ways of adjusting the volume of the inner compartment. Here obtained by a welding 31, which affects the inner compartment material 2 only. The welding 31 may be located differently according to the preferred volume of the inner compartment. The welding 31 further has the function of preventing the aroma material from being poured out of the container along with the brewed beverage.

Figure 18:
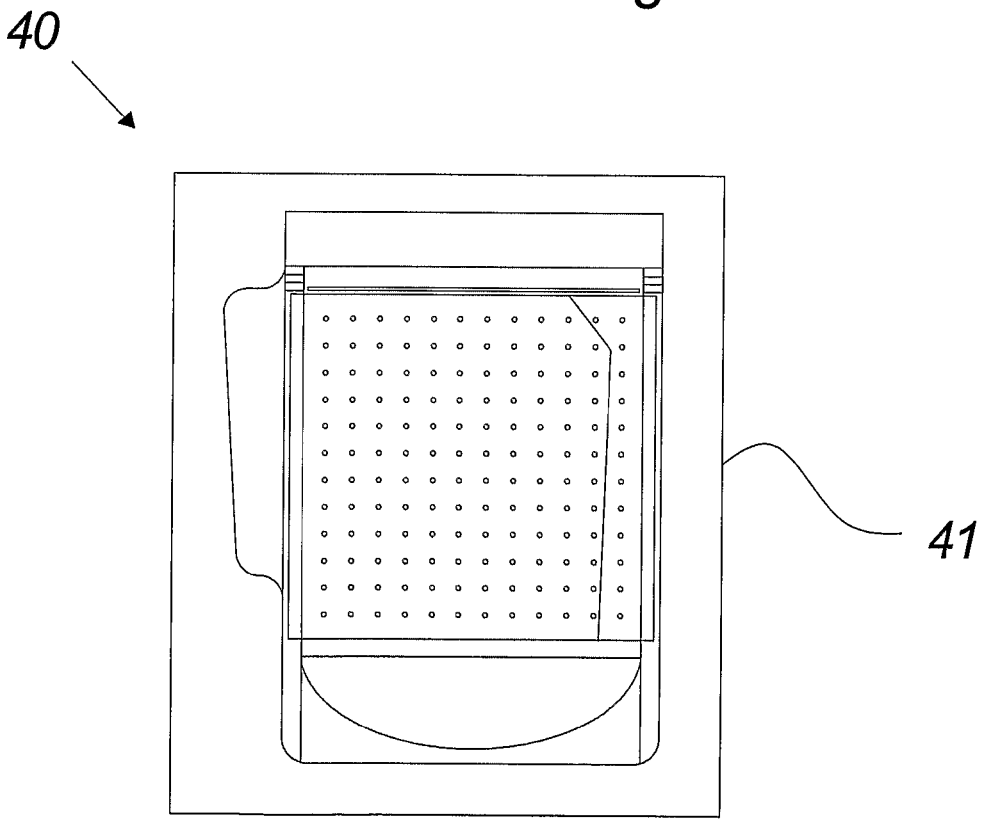

FIG. 18 illustrates an alternative embodiment 40, wherein a brewing device is being enclosed in a separate outer sealing 41. The outer sealing 41 may be rectangular, oval, bag-like or box-like etc. The design of the outer sealing 41 is not limiting for the scope of the invention.

An example of a specific preferred choice of materials for the purpose of making a brewing device for coffee brewing is stated below.

Sidewalls 6 of the brewing container may be made of a multi-layer laminate material comprising three layers: An outside layer made of PETP, an intermediate layer as barrier layer made of aluminium foil, e.g. a 9 μm foil and an inside layer forming a sealant comprising 150 μm high-density polyethylene (HDPE)

The bottom sheet 10 of the brewing container may be made of a multi-layer laminate material comprising three layers: An outside layer made of coextruded biaxially oriented polypropylene, e.g. of a thickness of 20 μm. An intermediate layer as barrier layer made of polyethylene terephthalate (PET) metallized and coated with ethylene vinyl alcohol (EvOH). An inside layer forming a sealant comprising, e.g. a 50 μm linear-low-density polyethylene (LLDPE) or high-density polyethylene (HDPE).

The inner compartment 4 may be made of 30 μm high-density polyethylene (HDPE) stamped with holes of 0.2*0.4 size and 8 holes per $cm^2$ density.

General comments to the choice of materials will be described below as it is stressed that the present invention is in no way restricted to the above-described material. One or several layers may be applicable for both the inner and the outer compartment. Moreover further compartments may be added both within the described compartments and evidently the brewing device according to the invention may be held within further packaging, e.g. an outer sealing. This is specifically important, if the aroma material is held unsealed within the brewing device.

Different shapes of the brewing device may likewise be applied within the scope of the invention. Different shapes of the bottom welding 9 may for example provide this shaping.

The invention claimed is:

1. A disposable brewing device comprising:

at least one inner compartment;

said inner compartment being formed by a liquid-permeable material and containing aroma material;

at least one outer compartment forming a brewing container;

said brewing container being formed by a liquid-impermeable material;

said at least one liquid-permeable inner compartment being integrated within said brewing container;

said at least one outer compartment being formed at least partly by a film material to be expandable from a non-expanded state when filled with liquid; and said brewing device being self-standing/self-supported during use for brewing.

2. A disposable brewing device according to claim 1, wherein said outer compartment is formed by film material.

3. A disposable brewing device according to claim 1, wherein said brewing device comprises a substantially air-, aroma-, and liquid-impermeable outer sealing.

4. A disposable brewing device according to claim 3, wherein said brewing container is forming an outer sealing of the brewing device.

5. A disposable brewing device according to claim 3, wherein the inner compartment material, the brewing container material and an outer sealing are formed as bags or pouches.

6. A disposable brewing device according to claim 3, wherein the brewing container and the inner compartment and an outer sealing are formed from sheets, webs, rolls or lengths of structural material.

7. A disposable brewing device according to claim 5, wherein said bags or pouches forming the brewing container, the inner compartment and the outer sealing are assembled by weldings at the edges.

8. A disposable brewing device according to claim 1, wherein heat resistance of structural material of the brewing container and inner compartment material is up to 100° C.

9. A disposable brewing device according to claim 1, wherein atmospheric pressure is sufficient for using the brewing device.

10. A disposable brewing device according to claim 1, wherein said liquid-impermeable material comprises walls and bottom of said brewing container .

11. A disposable brewing device according to claim 10, wherein said liquid-impermeable bottom material is more flexible than said wall material.

12. A disposable brewing device according to claim 1, wherein said liquid-impermeable material of the brewing container comprises at least one film or foil selected from the group comprising metal foils, polymer films, metallized films, coated films, polymer sealants, polyesters, polyamides and polyolefines comprising polyethylenes and polypropylenes and any combination thereof.

13. A disposable brewing device according to claim 1, wherein the liquid-impermeable material of the brewing container has a rigidity, which is large enough to allow the brewing container to be self-standing.

14. A disposable brewing device according to claim 1, wherein said liquid-impermeable material of the brewing container has a thickness in a range of 10 μm to 2 mm.

15. A disposable brewing device according to claim 1, wherein said liquid-impermeable material comprises a multi layer structure.

16. A disposable brewing device according to claim 1, wherein said brewing container comprises a translucent or at least semi-translucent liquid-impermeable material.

17. A disposable brewing device according to claim 16, wherein said translucent or at least semi-translucent liquid-impermeable material comprises an UV-filter.

18. A disposable brewing device according to claim 1, wherein a bottom of the brewing container comprises a shape sealed fold.

19. A disposable brewing device according to claim 1, wherein said brewing container forms at least a part of a fixation and support for the inner compartment.

20. A disposable brewing device according to claim 1, wherein said brewing container is formed as a stand-up pouch.

21. A disposable brewing device according to claim 1, wherein said brewing container comprises a discharging arrangement.

22. A disposable brewing device according to claim 1, wherein said brewing container is closed at a top by a peelable sealing.

23. A disposable brewing device according to claim 22, wherein said peelable sealing comprises a film strip or a peelable strip of a hot melt type.

24. A disposable brewing device according to claim 1, wherein said brewing container is equipped with at least one handle.

25. A disposable brewing device according to claim 1, wherein said brewing container comprises a top closing arrangement.

26. A disposable brewing device according to claim 25, wherein said closing arrangement comprises a flap, a slide fastener, an adhesive material or combinations thereof.

27. A disposable brewing device according to claim 1, wherein said liquid-permeable inner compartment material comprises at least one of punctured etched, melted, stamped or cut plast, polyolefines comprising polyethylene or polypropylene, polyesters, polyamides and other polymers, woven or non-woven expanded plastic, cloth, screen, wire-mesh, metal or injection molded plastic.

28. A disposable brewing device according to claim 1, wherein said liquid-permeable inner compartment material comprises a film material.

29. A disposable brewing device according to claim 1, wherein the liquid-permeable material of the inner compartment is provided with holes, which have been created by stamping, cutting, etching or melting.

30. A disposable brewing device according to claim 1, wherein the liquid-permeable material is provided with a density of holes in the range of 1-30 holes per $cm^2$.

31. A disposable brewing device according to claim 29, wherein said holes have dimensions in the range of 0.01 mm to 2.00 mm.

32. A disposable brewing device according to claim 29, wherein a dimension of said holes is adapted to provide a brewing time of approximately 3-6 minutes under atmospheric pressure.

33. A disposable brewing device according to claim 1, wherein the inner compartment is made of a material comprising at least one of poly-propylene, polyethylene, polyesters, polyamides or polyolefines or other polymers.

34. A disposable brewing device according to claim 1, wherein said brewing device is formed by mutually welded film materials.

35. A disposable brewing device according to claim 1, wherein said inner compartment comprises a pouch.

36. A disposable brewing device according to claim 1, wherein said inner compartment is sealed.

37. A disposable brewing device according to claim 1, wherein the inner compartment is open.

38. A disposable brewing device according to claim 1, wherein said inner compartment has a volume size in the range of 10 to 95% of the brewing container volume.

39. A disposable brewing device according to claim 37, wherein said volume size is regulated by a position of a welding seam in the inner compartment material.

40. A disposable brewing device according to claim 1, wherein at least two separate inner compartments are arranged inside or alongside each other.

41. A disposable brewing device according to claim 1, wherein the brewing container and the inner compartment are mutually fastened by welding.

42. A disposable brewing device according to claim 1, wherein said inner compartment comprises a bottom fold.

43. A disposable brewing device according to claim 1, wherein the outer sealing is made of a material selected from the group comprising metal foils, polymer films, metallized films coated films, polymer sealants, polyesters, polyamides and polyolefines comprising polyethylenes and polypropylenes and any combination thereof.

44. A disposable brewing device according to claim 1, wherein said outer sealing comprises a multi layer structure.

45. A disposable brewing device according to claim 1, wherein said outer sealing comprises a laminate.

46. A disposable brewing device according to claim 1, wherein structural material of the brewing container is coated with a protective film and/or a barrier layer.

47. A disposable brewing device according to claim 3, wherein said outer sealing comprises at least one polymer film, metallized or coated film, EvOH-coating, metal foil, sealant, or combinations thereof.

48. A disposable brewing device according to claim 1, wherein said multi layer structure of the brewing container material comprises an outside polymer film, an intermediate barrier layer and an inside layer of polymer sealant.

49. A disposable brewing device according to claim 1, wherein said aroma material comprises roast and/or ground coffee, instant coffee, tea, milk powder, herb, fruit, meat, chocolate powder, vegetables, grains or any combination thereof or any other materials which comprises or provides flavor or aroma or other functionalities.

50. Method of brewing a beverage in a disposable brewing device according to claim 1, comprising adding liquid into said brewing container under substantially atmospheric pressure.

51. Method of brewing coffee in a disposable brewing device according to claim 50, whereby the coffee is obtained by adding hot water into said brewing container under substantially atmospheric pressure.

* * * * *